US006532883B2

(12) United States Patent
Omiya et al.

(10) Patent No.: US 6,532,883 B2
(45) Date of Patent: Mar. 18, 2003

(54) SEWING MACHINE WITH PATTERN STITCHING FUNCTION

(75) Inventors: Koshiro Omiya, Tokyo (JP); Eiji Murakami, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 09/946,998

(22) Filed: Sep. 5, 2001

(65) Prior Publication Data

US 2002/0038622 A1 Apr. 4, 2002

(30) Foreign Application Priority Data

Sep. 29, 2000 (JP) ..... 2000-298076

(51) Int. Cl.[7] ..... D05B 3/02
(52) U.S. Cl. ..... 112/454; 112/456
(58) Field of Search ..... 112/456, 458, 112/457, 453, 454, 102.5, 470.06

(56) References Cited

U.S. PATENT DOCUMENTS 4,373,459 A * 2/1983 Dunn et al. ..... 112/454
4,499,836 A * 2/1985 Meier et al. ..... 112/445
4,660,488 A * 4/1987 Hanyu et al. ..... 112/454
4,815,406 A * 3/1989 Brown et al. ..... 112/454 X
4,873,931 A * 10/1989 Takagi et al. ..... 112/255 X

* cited by examiner

*Primary Examiner*—Peter Nerbun
(74) *Attorney, Agent, or Firm*—Nields & Lemack

(57) ABSTRACT

A sewing machine with pattern stitching function is disclosed, wherein pattern data may be optionally selected to control the swinging movement of the vertically reciprocating needle and the work feeding amount of the work feeding mechanism, thereby to form a pattern composed of a plurality of pattern elements, the selected pattern data being modified with respect to each of the pattern elements.

4 Claims, 4 Drawing Sheets

SEWING MACHINE WITH PATTERN STITCHING FUNCTION

BACKGROUND OF THE INVENTION AND RELATED ART STATEMENT

1. Field of the Invention

The present invention relates to a sewing machine with pattern stitching function and more particularly relates to pattern data which may be selectively used to form an optional stitch pattern including a plurality of pattern elements, the pattern data being optionally modified with respect to each of the pattern elements.

2. Prior Art

It has been generally prevalent that the sewing machine is operated under control of a zigzag stitch producing mechanism and a work feeding amount adjusting mechanism to form a pattern of zigzag stitches. Namely, according to the conventional sewing machine with pattern stitching function, the pattern data are particularly provided to each of the different patterns to be selectively formed. Therefore, in case a pattern is modified or varied, it is required that the pattern data is modified or varied accordingly in its entirety.

However, actually it is often required to modify or vary a pattern, particularly as to the individual pattern elements which form the pattern, instead of modifying the entire pattern.

In this case, it may be considered that the pattern is divided into the elements to be individually modified or varied so that the modified or varied pattern elements may be reconstructed into a pattern. It is, however, very difficult to position the individual pattern elements so as to form a single pattern.

OBJECTS OF THE INVENTION

The invention has been provided to eliminate the defects and disadvantages of the prior art. It is, therefore, an object of the invention to provide a sewing machine with pattern stitching function which may be operated under control of pattern data to form a pattern of a plurality of different pattern elements, the pattern data being modified or varied with respect to each of the pattern elements.

SUMMARY OF THE INVENTION

For attaining the object of the invention, the sewing machine substantially comprises a needle mechanism including a vertically reciprocating needle and a work feeding mechanism including a feed dog for transporting a work relative to the needle so as to be stitched, the needle mechanism being swingable transversely of the direction in which the work is transported, the needle mechanism and the work feeding mechanism being operated under control of pattern data to form a pattern of stitches on the work, means for giving pattern data for producing a stitch pattern composed of a plurality of pattern elements, means for modifying the pattern data for each of said pattern elements.

With combination of the elements including the means for modifying the pattern data for each of said pattern elements, the variation of a stitch pattern may be increased. Further, since the pattern is formed by a set of pattern data, the stitching position may be easily changed.

According to a preferred embodiment, the pattern may be composed of a portion of dense zigzag stitches and a portion of one or more straight stitches. Therefore, in case the pattern data for modifying the straight stitch portion is optionally changed, the pattern may be modified in so many ways. It is needless to say that the zigzag stitch portion may be modified, instead of the straight stitch portion.

The pattern of dense zigzag stitches may be replaced by another pattern of other stitches than the zigzag stitches.

Preferably, the pattern data may includes the data for controlling the zigzag stitch width, the data for controlling the work feeding amount and the data for controlling the thread tension. The thread tension may be changed for the zigzag stitch portion and for the straight stitch portion to obtain an optimal stitch pattern.

DETAILED DESCRIPTION OF PREFERRED EMBODIMENTS

The invention will be described in detail in reference to a preferred embodiment as shown in the attached drawings.

Figure 1:
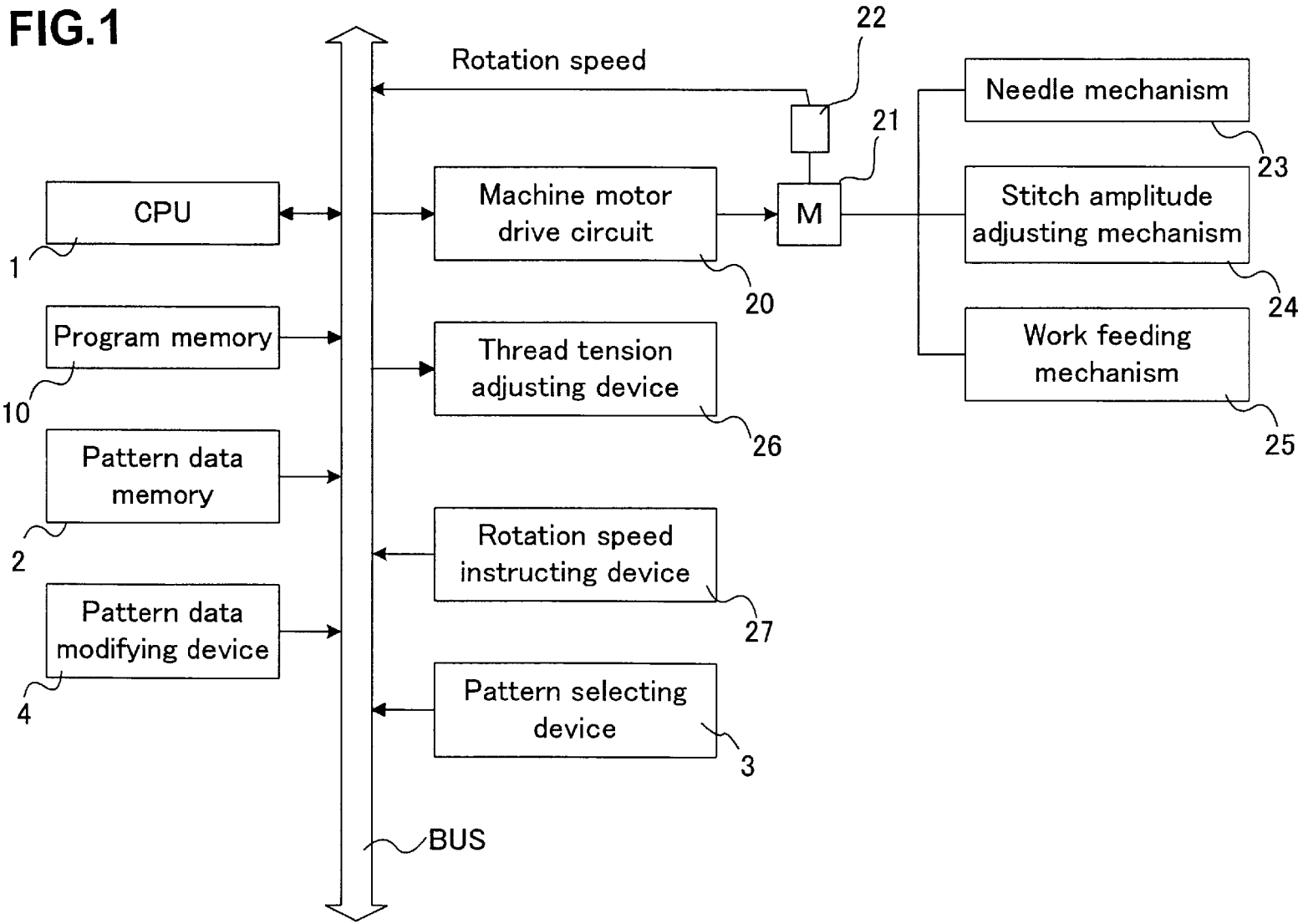
FIG. 1 is a block diagram showing the functions of a sewing machine of the invention.

In FIG. 1, CPU 1 is provided to control the operation of a sewing machine in accordance with programs stored in a program memory 10. The CPU 1 is responsive to an instruction from a rotation speed instructing device 27 including a speed controller to control a machine motor drive circuit 20, thereby to control the rotation speed of a machine motor 21. Thus the machine motor 21 will operate a needle mechanism 23 and a work feeding mechanism 25 at a speed as instructed by the rotation speed instructing device 27.

The number of rotations of the machine motor 21 is detected by a rotation detector 22 and is feedbacked to the CPU 1 for controlling the rotation speed of the machine motor 21.

The needle mechanism 23 is so formed as to be moved by a stitch amplitude producing mechanism 24 in a direction transversely of the direction in which the work is transported by the work deeding mechanism 25, thereby to form zigzag stitches of optional amplitude (zigzag stitch width). The CPU 1 is responsive to pattern data from the program memory 10 to control the stitch amplitude and the work feeding amount (stitch length) through the stitch amplitude adjusting mechanism 24 and the work deeding mechanism 25 respectively, thereby to form various patterns of stitches.

Further, the CPU 1 is responsive to pattern data from the program memory 10 to control the operation of a thread tension adjusting device 26.

A pattern data memory 2 has pattern data stored therein which may be optionally selected by operation of a pattern selecting device 3 and may be modified by operation of a pattern data modifying device 4 with respect to the predetermined elements which form a single pattern.

Figure 2:
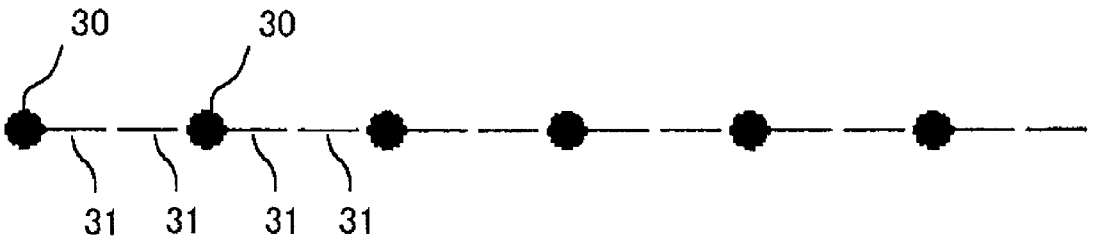
FIG. 2 is an explanatory view of a composite pattern, shown by way of example, to be formed by the sewing machine of the invention.
Figure 3:
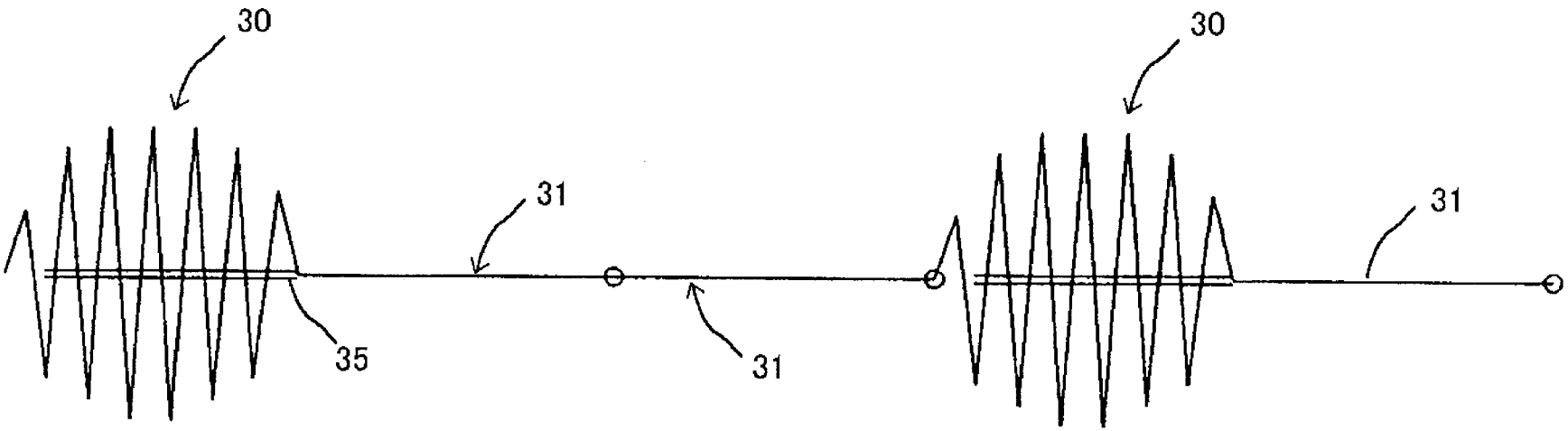
FIG. 3 is an enlarged view of the pattern as shown in FIG. 2.

FIGS. 2 and 3 show a composite pattern, that is, the pattern of French knots by way of example formed by the pattern data stored in the pattern memory 2.

Here the French knot pattern is composed of a series of patterns including two painted out elements 30, 30 and the two straight line elements 31, 31 located between the two painted out elements 30, 30. The pattern data may be modified by the pattern data modifying device 4 for each of the painted out elements 30, 30 and straight line elements 31, 31. The pattern data stored in the pattern data memory 2 include the data for controlling the operation of thread tension adjusting device 26 in addition to the data for controlling the operation of the work feeding mechanism 25 and of the stitch amplitude adjusting mechanism 24. The pattern data may be modified regarding a plurality of predetermined elements to be stitched. in a composite stitch pattern.

Figure 4:
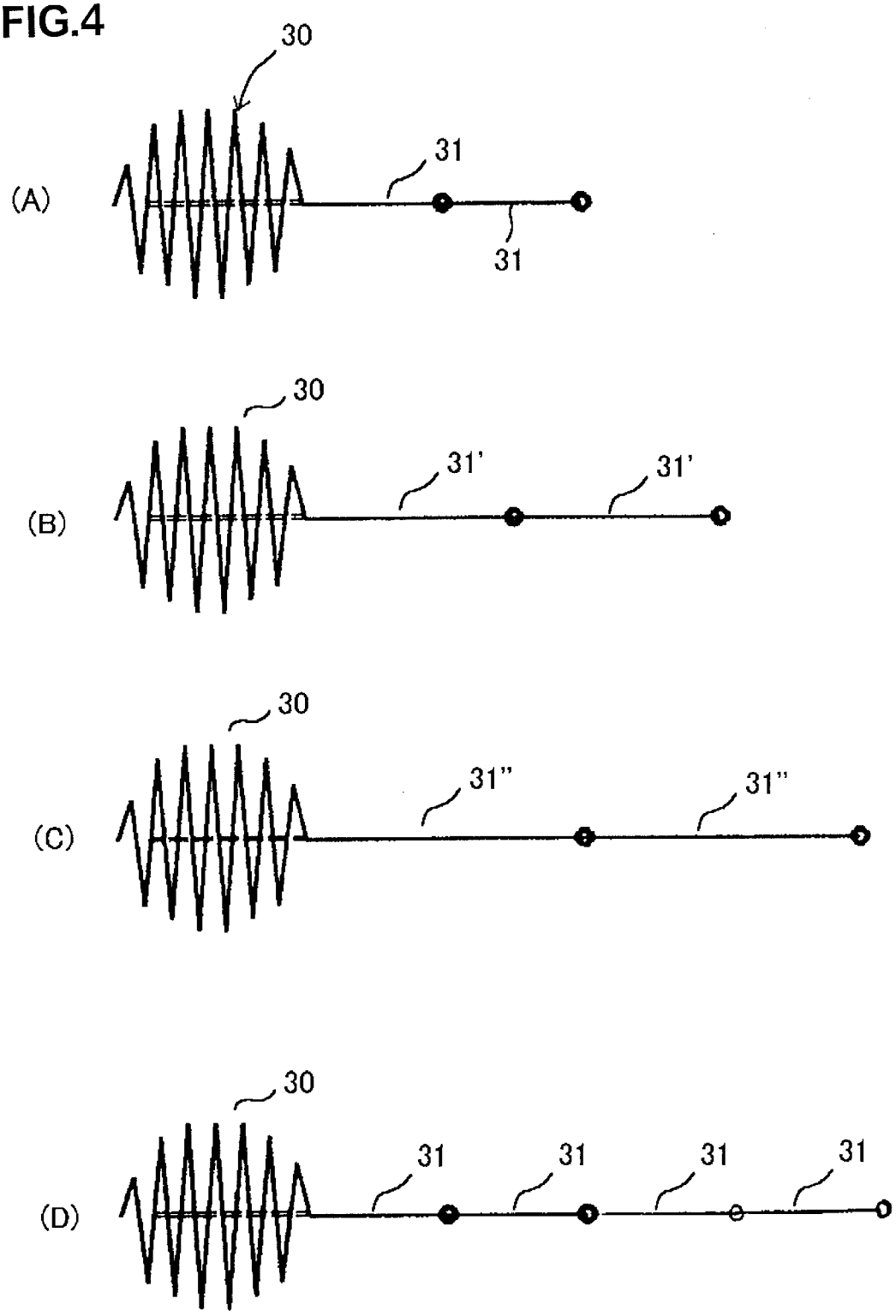
FIGS. 4(A) through (D) are explanatory views of the pattern shown as modified in so many ways.

FIG. 4 shows the examples of patterns formed by the pattern data as modified. In FIG. 4, (A) shows a stitch pattern formed by use of the data before the same is modified. (B) shows the same stitch pattern, but having the straight stitch lines 31', 31' elongated as compared with the straight stitch lines 31, 31 of (A). (C) shows the same stitch pattern, but having further elongated straight stitch lines 31", 31" as compared with the straight stitch lines 31', 31' of (B).

Further, (D) shows the stitch pattern modified to have the straight stitch lines 31 increased up to four.

Figure 5:
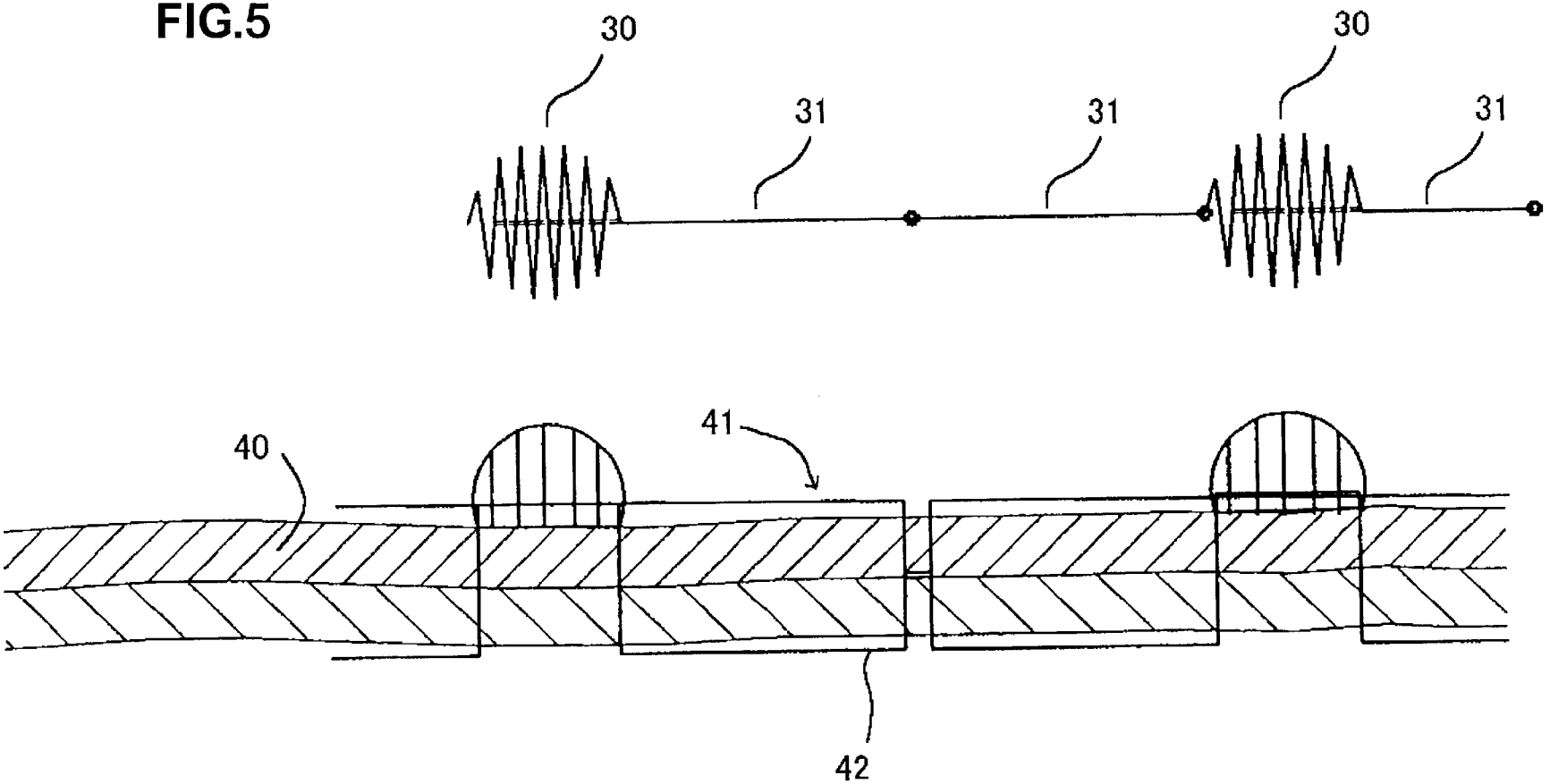
FIG. 5 is an explanatory view of the pattern shown in connection with variation of thread tension.

FIG. 5 shows the thread tension set to each of the pattern elements of the composite pattern. As to the zigzag stitch portions, that is, the painted out portions 30 in FIG. 2, the thread tension adjusting device 26 is adjusted to give the upper thread 41 a high tension such that the lower thread 42 may be exposed at the upper side of the work 40, thereby to give the painted out portions 30 a voluminous appearance. On the other hand, as to the straight lines 30, the thread tension adjusting device 26 is adjusted to give the lower thread 41 a normal tension such that the lower thread 42 may not be exposed at the upper side of the work 40.

FIG. 3 shows generally circular patterns 30 of zigzag stitches corresponding to the painted out portion 30 in FIG. 2, the amplitude of the zigzag stitches being varied per stitch. Such variation of stitch amplitude will prevent the work or cloth from being shrunk which may otherwise be caused.

The circular pattern 30 includes a reverse stitch portion 35 formed as the work transported in the reverse direction so as to prevent a skipped stitch at the time of formation of the next straight stitch 31.

According to the embodiment of the invention, the circular pattern portion, that is, the painted out portion 30 and the straight stitch portions 31, 31 form one composite pattern with variation of the pattern data with respect to each of the pattern elements. As the result, the composite pattern may be modified in many ways as shown in FIGS. 4(A) through (D) with the thread tension being adjusted accordingly with respect to each of pattern elements as shown in FIG. 5.

Further, since the painted out portion 30 and straight portions 31, 31 form a single composite pattern, the pattern may be displaced in its entirety in the width direction thereof.

As is described above, according to the invention, the pattern data for forming a stitch pattern of a plurality of pattern elements may be modified with respect to each of the pattern elements. It is, therefore, apparent that the formation of a variety of patterns may be realized.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A sewing machine with pattern stitching function having a needle mechanism including a vertically reciprocating needle and a work feeding mechanism including a feed dog for transporting a work relative to the needle so as to be stitched, the needle mechanism being swingable transversely of the direction in which the work is transported, the needle mechanism and the work feeding mechanism being operated under control of pattern data to form a pattern of stitches on the work, said sewing machine comprising:

(a) means for giving pattern data for producing a stitch pattern composed of a plurality of pattern elements;

(b) means for modifying said pattern data for each of said pattern elements so as to modify only a part of said pattern.

2. A sewing machine with pattern stitching function having a needle mechanism including a vertically reciprocating needle and a work feeding mechanism including a feed dog for transporting a work relative to the needle so as to be stitched, the needle mechanism being swingable transversely of the direction in which the work is transported, the needle mechanism and the work feeding mechanism being operated under control of pattern data to form a pattern of stitches on the work, said sewing machine comprising:

(a) means for giving pattern data for producing a stitch pattern composed of a pattern of zigzag stitches in a predetermined shape and more than one or two straight stitch portions;

(b) means for modifying only the pattern data for producing said straight stitch portions.

3. The sewing machine as defined in claim 1, wherein said pattern data includes data for controlling the operation of said work feeding mechanism, data for controlling the swinging movement of said needle mechanism and data for adjusting a thread tension, and wherein said data modifying means modifies said work feeding mechanism controlling data and said needle mechanism controlling data.

4. The sewing machine as defined in claim 2, wherein said pattern data includes data for controlling the operation of said work feeding mechanism, data for controlling the swinging movement of said needle mechanism and data for adjusting a thread tension, and wherein said data modifying means modifies said work feeding mechanism controlling data and said needle mechanism controlling data.

* * * * *